United States Patent [19]

Hilgendorf et al.

[11] 4,131,870

[45] Dec. 26, 1978

[54] SLIDE RESISTOR

[75] Inventors: Joachim Hilgendorf, Salz; Karl-Heinz Funke, Bad Neustadt, both of Fed. Rep. of Germany

[73] Assignee: Preh, Elektro-Feinmechanische Werke, Jakob Preh Nachf, Fed. Rep. of Germany

[21] Appl. No.: 809,868

[22] Filed: Jun. 24, 1977

[30] Foreign Application Priority Data

Jun. 26, 1976 [DE] Fed. Rep. of Germany ... 7620297[U]

[51] Int. Cl.[2] ..... H01C 10/44

[52] U.S. Cl. ..... 338/183; 338/176; 338/184; 338/188; 338/202

[58] Field of Search ..... 338/160, 165, 167, 170, 338/171, 176, 183, 184, 188, 202

[56] References Cited

U.S. PATENT DOCUMENTS

| | | | |
|---|---|---|---|
| 3,887,892 | 6/1975 | Rozema et al. | 338/183 |
| 3,928,838 | 12/1975 | Leppek | 338/183 |
| 4,005,381 | 1/1977 | Klug | 338/183 |

*Primary Examiner*—C. L. Albritton
*Attorney, Agent, or Firm*—Beall & Jeffery

[57] ABSTRACT

An elongate bar of electrically conductive material and having a generally U-shaped cross-section carries on the inner side of one of its legs a support with a resistance layer facing towards the other leg. A slider is guided between the two legs of the bar and has a contact spring, one contact tongue of the spring bearing on the resistance layer and another contact tongue bearing on the opposite, second leg of the bar forming a collector element. A nose formed on the slider engages a groove which exists between the resistance element and the bent free end of the one leg of the elongate bar, to guide the slider. A cover plate overlies the opening of the U-shaped cross-section of the elongate bar. An operating knob is disposed outside the cover plate and extends through a slot in the cover plate operatively to engage the slider.

12 Claims, 5 Drawing Figures

18
20
22
17
19
13
12

4
17
21
31
30
8
29
4
10
16
15
28
27
13
11
14
16
9

SLIDE RESISTOR

BACKGROUND OF THE INVENTION

This invention relates to a slide resistor and more specifically to a slide resistor of the type wherein the resistance element consists of an insulating support mounted on an electrically conductive collector element and provided with a resistance layer, the slider carrying the sliding contact spring being guided by the collector element.

Adjustable slide resistors of this type are often used with appliances in the audio and video field for controlling operational values, such as sound, contrast, volume, brightness, and the like. In contrast to rotary variable resistors, slide resistors have the advantage that they allow a better control of the intended adjustment along a linear scale. Slide resistors have been used for some time in studio equipment; they are now becoming usual also in domestic installations, e.g. in connection with dimmers and timers, where they replace rotary resistors.

An electrical device for controlling the brightness of a lamp is known, which device is adapted to be mounted in a commercially available flush-mount box and includes a carrier plate which is provided at its lower side with conductor strips and a coil and at its upper side with a rotary resistor combined with a push button switch having a shaft for an actuating knob, terminals for connecting lines and other electronic elements.

Slide resistors are increasingly employed in dimmers of this kind to take advantage of their improved position-indicating facility.

In a prior art resistor consisting essentially of a resistance element mounted on an insulating plate, a collector element and a slider having a slider contact spring and terminals for the electrical connections, the collector element is formed as a flat stamped metal part having a bent edge. The collector element carries both the slider and the insulating plate with the resistance element mounted thereon. A corresponding profile of the collector element provides a guide for the slider which engages the upper portion of the collector element having the bent edge in a manner free of play. As generally required with profile guides, the slider must be manufactured with close tolerances to achieve a smooth sliding motion. This, however, increases the costs of such a slide resistor which is produced in large quantities. Another slide resistor is known in which the slider is guided by a bent edge of the collector element, the edge engaging in a groove formed on the inner side of the slider. The resistance element and the collector element are mounted in parallel relation on an insulating plate. The slider is formed with short projections extending around an edge of the insulating plate to prevent the slider from tilting. By disposing the resistance element and the collector element parallel to each other on the insulating plate, a slide resistor of a small structural height is obtained, provided that the plane of the insulating plate extends parallel to the printed circuit board to which the slide resistor is soldered. However, when the plane of the insulating plate extends perpendicularly to the printed circuit board, the space required in the lateral direction is small but the height is considerable. This is particularly disadvantageous in electrical wiring devices because the limited available space is mainly taken by electronic elements. This is especially true for those devices which function as timers or the like in addition to the dimmer function and therefore require additional electronic elements.

It is an object of the invention to provide a slide resistor in which the above disadvantages are overcome. It is a further object of the invention to devise a slide resistor which requires little space with respect to both height and width. As another object of the invention, a slide resistor is to be provided which allows a smooth sliding movement. It is a still further object of the present invention to provide a slide resistor which is of uncomplicated design and lends itself to mass production.

SUMMARY OF THE INVENTION

A slide resistor in accordance with the present invention comprises collector means of high electrical conductivity formed as an elongate structure of generally U-shaped cross-section and having a pair of legs and a first slot therebetween, resistance means including an insulating support mounted on a first one of said pair of legs and carrying a resistance layer facing the second one of said pair of legs, and slider means guided between said pair of legs and including contact spring means for contacting said collector means and said resistance layer, and an actuating member engaging said contact spring means and extending through said first slot for operation from outside said collector means. A slide resistor of compact design is thus achieved in which the slider is excellently guided to provide an easy and shockless sliding motion free of play.

In a preferred embodiment of the invention, the guiding of the slider is even further improved in that the free end of the first leg of the collector means is bent to form a groove with said resistance means with said slider means having a nose engaging said groove, and in that said slider means includes sliding surfaces engaging said collector means.

According to another preferred embodiment, balanced contact forces and a further improved guide for the slider means are achieved in that said contact spring means has a first contact tongue disposed on one side of said slider means and contacting said resistance layer, and a second contact tongue disposed on the other side of said slider means and contacting said second leg of said collector means. Preferably, the slider means is formed with a window through which said other contact tonque projects to contact said second collector leg.

In a still further preferred embodiment of the invention, the slide resistor is adapted to be mounted on a printed circuit board with said legs of the collector means extending perpendicularly to the printed circuit board, the board forming the base of a housing, wherein said actuating member has a catch engaging said slider means and extending through a second slot formed in a first cover plate closing said housing. To prevent direct access to the interior of the housing from the outside, it is preferred to provide the housing with a second cover plate disposed above the first cover plate and having a third slot laterally offset with respect to the second slot.

BRIEF DESCRIPTION OF THE DRAWINGS

Further objects, advantages and details of the invention will become apparent from the following description of a preferred embodiment with reference to the drawings. In the drawings

DETAILED DESCRIPTION OF PREFERRED EMBODIMENT

Figure 1:
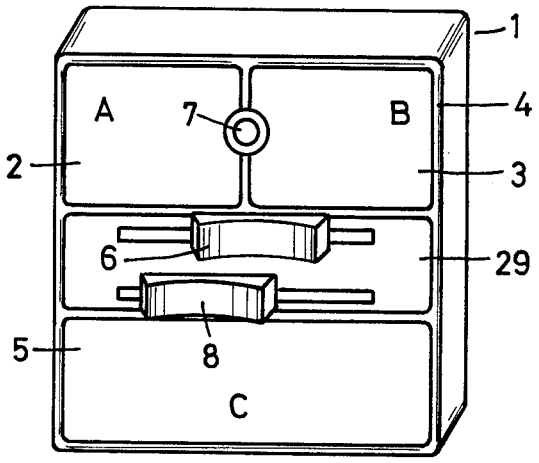
FIG. 1 is an isometric view of a controlling device including two slide resistors.

As an embodiment of the slide resistor in accordance with the present invention, which is characterized by small structural height and width, a controlling device 1 forming part of a domestic electical wiring installation is shown in the drawings. Alternatively, the slide resistor could be employed in dictating machines, portable radio receivers or the like.

FIG. 1 shows an isometric view of a dimmer including sensor switches and a presettable time delay. Fields 2 and 3 of a first cover plate 4 represent sensor switches by means of which the dimmer may be switched on and off, respectively. The brightness of the lamp is adjusted by a slide resistor in operating an actuating knob 6. When the dimmer is switched on, an indicator lamp 7 is lit. In the lower field of the cover plate 4, a time delay may be preset. The field 5 is formed as a sensor switch, and the time delay may be adjusted by means of another slide resistor by operating an actuating knob 8 associated therewith. The possibility of selecting the switch-off time is advantageous particularly in those instances where a lamp is required only for a certain period of time before sleep, such as in children's bedrooms. A similar time-delayed switching may be employed for hall and staircase lighting.

Figures 2, 3:
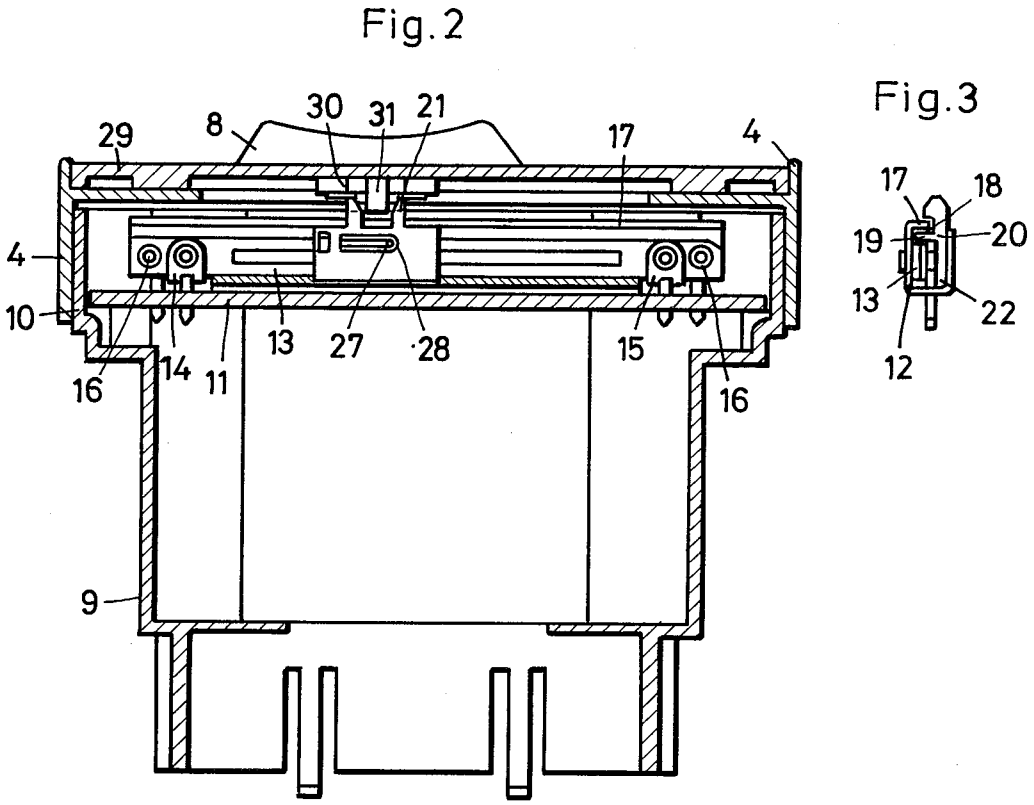
FIG. 2 is an enlarged cross-section cutting through one of the two slide resistors of the device shown in FIG. 1.
FIG. 3 is a cross-section through the slide resistor portion of FIG. 2.

FIG. 2 shows a cross-section through the controlling device which is adapted to be inserted in a commercially available flush-mount box. These portions and electronic elements that are not essential to the invention are omitted from FIG. 2. The lower portion 9 of a plastic housing of the device is circular in cross-section and extends into the box. The framelike square upper housing portion 10 projects above the wall surface so that its height is limited for aesthetical and design reasons. The bottom of this housing portion 10 is formed by a printed circuit board 11 to which the slide resistors are soldered in addition to other electronic elements. One slide resistor is shown in FIG. 1 in longitudinal section. A cross-section through the same slide resistor is shown in FIG. 3.

The housing of the slide resistor is formed by a collector element 12 which is made of metal and — as seen from FIG. 3 — has a U-shaped cross-section. A resistance element 13 is riveted to the inner side of one leg of the collector element 12. The resistance element consists of a support of insulating material onto which a resistance layer has been deposited in a known manner.

Start and end connecting lugs 14 and 15 shown in FIG. 2 are mounted on the support also by rivets. At the locations of those rivets, the collector element is provided with recesses (not shown in the Figures) to avoid electrical contact. The resistance element 13 itself is fixed to the inner side of the leg of the connector element 12 by means of rivets 16, with the resistance layer avoiding those rivets.

Figure 4:
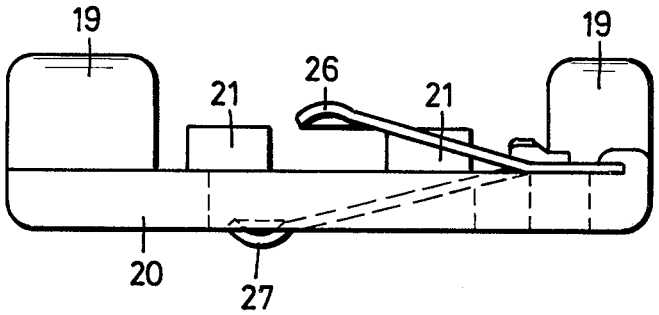
FIG. 4 is an enlarged view of the slider taken from above in FIG. 3.
Figure 5:
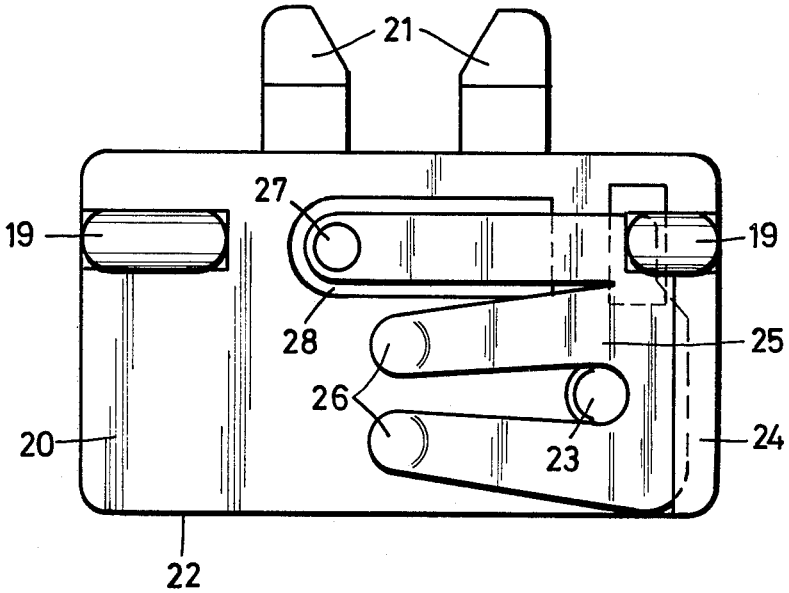
FIG. 5 is a side view of the slider of FIG. 4.

The free end of the leg to which the resistance element 13 is fixed, has a bent portion 17 which forms together with the resistance element 13 a groove 18 for guiding noses 19 of a slider 20. As best seen in FIGS. 4 and 5, the noses 19 are formed integrally with the slider 20 just as are projections 21 which serve operatively to connect the slider 20 to the actuating knob 8. When the slider 20 is inserted into the U-shaped collector element 12, its lower longitudinal edge 22 forms a sliding surface bearing on the buttom and/or one leg of the collector element 12.

The base portion 25 of a sliding contact spring is mounted on the slider 20 by means of an undercut portion 24 and a heat-moulded retaining pin 23. The sliding contact spring has two contact tongues 26 to improve the contact between the contact spring and the resistance element 13, while only one contact tongue 27 is provided for contacting one of the legs of the collector element 12. The contact tongue 27 extends through a window 28 formed in the slider 20 towards the other side, so that the contact tongues for the resistance element and the collector element are disposed on opposite sides of the slider. An improved smooth sliding motion is thereby achieved and the outer dimensions can be reduced.

The housing portion 10 is closed by the cover plate 4 which engages the housing portion by a snap-action. A further, smaller cover plate 29 is also connected to the housing portion 10 by snap-action. By changing this further cover plate, the device may easily be adapted to other applications, e.g. those in which only one slide resistor is used. Both cover plates each include a slot with the two slots being laterally offset with respect to each other. The operating knob 8 is guided in the slot of the further cover plate and consists of two portions. The upper knob portion forms the actuating knob 8 proper which is fixed to the portion 30 disposed inside the housing by heat-moulding of pins penetrating the slot. A catch 31 is provided on the lower portion 30 at a position laterally offset with respect to the slot of the cover plate 29, the catch 31 extending into the projections 21 of the slider 20. The ends of the slot in the cover plate 29 confine the sliding motion of the slider. The slots in the two cover plates are offset to form kind of a libyrinth in order to prevent direct ingression of an object such as a screw driver into the interior of the device.

What is claimed is:

1. A slide resistor comprising
   (a) collector means of high electrical conductivity formed as an elongate structure of generally U-shaped cross-section and having a pair of legs and a first slot therebetween.
   (b) resistance means including an insulating support mounted on a first one of said pair of legs and carrying a resistance layer facing the second one of said pair of legs, and
   (c) slider means guided between said pair of legs and including contact spring means contacting said collector means and said resistance layer, and an actuating member engaging said contact spring means and extending through said first slot for operation from outside said collector means.

2. The slide resistor of claim 1, wherein the free end of said first leg is bent to form a groove with said resistance means, said slider means having nose engaging said groove, and wherein said slider means includes sliding surfaces engaging said collector means.

3. The slide resistor of claim 2, wherein said contact spring means has a first contact tongue disposed on one side of said slider means and contacting said resistance layer, and a second contact tongue disposed on the other side of said slider means and contacting said second leg of said collector means.

4. The slide resistor of claim 3, wherein said slider means has an undercut portion receiving a base portion of said contact spring means, and a projecting portion adapted to be formed so as fixedly to retain another portion of said contact spring means.

5. The slide resistor of claim 4, wherein said undercut portion, said projecting portion and nose means are provided on the same side of said slider means, said other contact tongue projecting through a window formed in said slider means.

6. The slide resistor of claim 1, wherein said insulating support has portions free of said resistance layer and riveted to said first leg of said collector means.

7. The slide resistor of claim 1 and adapted to be mounted on a printed circuit board, with said legs extending perpendicularly to said board, the board forming the base of a housing, said actuating member having a catch engaging said slider means and extending through a second slot formed in a first cover plate closing said housing.

8. The slide resistor of claim 7, wherein said housing includes a second cover plate disposed above said first cover plate and having a third slot guiding said actuating member.

9. The slide resistor of claim 8, wherein said third slot is laterally offset with respect to said second slot.

10. The slide resistor of claim 8, wherein said actuating member includes first and second portions respectively disposed on the outer and inner sides of said first cover plate, and means extending through said second slot for interconnecting said first and second actuating member portions.

11. The slide resistor of claim 10, wherein said second actuating member portion has said catch mounted thereon at a position offset with respect to said second slot.

12. The slide resistor of claim 8, wherein said third slot has two ends limiting the slide motion of said slider means.

* * * * *